US011668450B2

(12) United States Patent
Garber

(10) Patent No.: US 11,668,450 B2
(45) **Date of Patent: *Jun. 6, 2023**

(54) LED LAMP WITH HIGH TRANSMITTANCE OPAQUE DIFFUSER

(71) Applicant: EmeryAllen, LLC, Mt. Pleasant, SC (US)

(72) Inventor: Thomas Garber, Daniel Island, SC (US)

(73) Assignee: EmeryAllen, LLC, Mt. Pleasant, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/667,367

(22) Filed: Feb. 8, 2022

(65) Prior Publication Data

US 2022/0235914 A1 Jul. 28, 2022

Related U.S. Application Data

(63) Continuation of application No. 17/221,757, filed on Apr. 2, 2021, now Pat. No. 11,242,974, which is a continuation-in-part of application No. 29/767,789, filed on Jan. 26, 2021, now Pat. No. Des. 933,858.

(60) Provisional application No. 63/123,096, filed on Dec. 9, 2020.

(51) Int. Cl.

| | |
|---|---|
| ***F21V 3/06*** | (2018.01) |
| ***F21V 23/00*** | (2015.01) |
| ***F21K 9/66*** | (2016.01) |
| ***F21K 9/232*** | (2016.01) |

(Continued)

(52) U.S. Cl.

CPC ..... *F21V 3/0625* (2018.02); *F21K 9/232* (2016.08); *F21K 9/237* (2016.08); *F21K 9/66* (2016.08); *F21V 23/003* (2013.01); *F21V 23/006* (2013.01); *F21Y 2115/10* (2016.08)

(58) Field of Classification Search

CPC .... F21V 3/0625; F21V 23/003; F21V 23/004; F21V 23/006; F21V 23/009; F21K 9/20; F21K 9/23; F21K 9/232; F21K 9/233; F21K 9/235; F21K 9/237; F21K 9/238; F21K 9/60; F21K 9/66; F21K 9/69; F21Y 2115/10

See application file for complete search history.

(56) References Cited

U.S. PATENT DOCUMENTS 11,242,974 B1 * 2/2022 Garber ..... F21K 9/232
2011/0248619 A1 * 10/2011 Loh ..... F21K 9/232 313/46

(Continued)

*Primary Examiner* — Alan B Cariaso
(74) *Attorney, Agent, or Firm* — Gregory Finch; Finch Paolino, LLC

(57) ABSTRACT

Embodiments of the present disclosure provide for a light emitting apparatus comprising a directional LED array and an opaque lens configured to disperse light in an omnidirectional output pattern while maintaining similar light dispersion and heat dissipation performance as that of translucent lenses. In accordance with various aspects of the present disclosure, the desired optical properties of the present light emitting apparatus may be enabled through the use of a lens constructed from a polycarbonate or polycarbonate blend material melt blended with a concentration of organic diffusion particles to comprise a thermoplastic matrix having a desired opacity and optical characteristics.

19 Claims, 7 Drawing Sheets

(51) Int. Cl.
*F21K 9/237* (2016.01)
*F21Y 115/10* (2016.01)

(56) References Cited

U.S. PATENT DOCUMENTS

| | | | | |
|---|---|---|---|---|
| 2012/0018754 | A1* | 1/2012 | Lowes | G02F 1/1334 257/E33.059 |
| 2012/0075854 | A1* | 3/2012 | Maxik | F21K 9/90 29/832 |
| 2012/0230034 | A1* | 9/2012 | Boomgaarden | F21V 17/164 362/294 |
| 2013/0010465 | A1* | 1/2013 | Wang | F21V 29/506 362/296.01 |
| 2014/0191653 | A1* | 7/2014 | Edmond | H05B 33/22 438/27 |
| 2015/0103511 | A1* | 4/2015 | Miyashita | H01L 33/508 29/428 |
| 2020/0072453 | A1* | 3/2020 | Mittal | F21V 19/003 |

* cited by examiner

Prior Art

LED LAMP WITH HIGH TRANSMITTANCE OPAQUE DIFFUSER

CROSS REFERENCE TO RELATED APPLICATIONS

The present application is a continuation of U.S. application Ser. No. 17/221,757 filed Apr. 2, 2021, which is a continuation-in-part of U.S. design application Ser. No. 29/767,789 filed Jan. 26, 2021, and also claims priority benefit of U.S. Provisional Application Ser. No. 63/123,096 filed Dec. 9, 2020; the entirety of each of these applications are incorporated herein at least by virtue of this reference.

FIELD

The present disclosure relates to the field of light emitting diode (LED) lamps; in particular, a chip-on-board LED lamp comprising an opaque diffuser with improved optical properties.

BACKGROUND

Polymer particles are used in polymer matrixes to manage light diffusion in light bulbs. For example, U.S. Pat. No. 7,547,736 describes the use of particles having an average particle size of 15 to 70 microns to provide a frosted look and textured surface, and U.S. Pat. No. 8,163,827 describes a high light transmission diffusion screen having inorganic pigments and refractive index-matched particles.

Point light sources create a visible shape of the light source, and there is often a desire to hide the light source shape, creating a more diffuse lighting. As used herein, "point light source" means any shaped source of electromagnetic radiation in the 3,600-7,700 Angstrom range. This includes, but is not limited to, incandescent, fluorescent, neon, argon and LED light sources.

Light emitting diodes (LEDs) are increasingly in favor as a light source, since they use far less electricity and produce less heat than standard incandescent or fluorescent light bulbs. LEDs provide a very bright, point light source, yet the output (7000° K.) often appears harsh and causes an uncomfortable glare. Likewise, the visibility of surface mounted LEDs within an LED bulb, either when the bulb is ON or OFF, can be aesthetically displeasing in certain lighting applications.

These luminous devices typically consist of a light source and a cover (also called a lens or a diffuser) made of a plastic whose function is to mask and protect the light source, while still ensuring good transmission of the light emitted by the light source. The plastic may be pigmented and/or may have decorative elements or patterns. The cover also has the function of scattering the emitted light so that the illumination is softened and not dazzling. Some covers may be configured as a Fresnel-style lens (or other lens type) to soften and disperse light according to certain desired characteristics. Alternatively, the scattering of light emitted by the light source can be achieved by dispersing scattering particles of organic or mineral nature in the plastic.

International Pub. No. WO 2006/100126 describes a thermoplastic cover with dispersed beads for use with LEDs to form luminous devices; 3-30% of scattering particles are dispersed in a transparent plastic. The particles can be inorganic or organic and have mean diameters of from 0.5 to 100 microns. There is no description of combinations of particle size and loading, and no teaching of hiding power.

The addition of scattering particles helps to soften the effect of the LED light source, but the scattering also reduces light transmission. Some LED lighting cover manufacturers add pigments, such as BaSO4, SiO2, CaCO3, AL2O3, TiO2 and ZnO (U.S. Pat. No. 4,418,986), to the cover to increase the hiding power, though this can dramatically decrease the light transmission. BaSO4 and refractive-index-matched beads are used in a light diffusion (TV) screens in U.S. Pat. No. 8,163,827. Ground-up cell-cast sheet forms irregular particles with a wide particle size distribution, and unsatisfactory light transmission properties for LED diffusion sheets.

International Pub. No. WO 2014/055330 describes an attempt to balance the light transmission and hiding power for an LED diffuser, using a combination of different sized plastic beads.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Certain aspects of the present disclosure provide for a light emitting apparatus comprising a base portion comprising an electrical connector configured to receive a flow of power from a power source; a body portion coupled to the base portion, the body portion being substantially cylindrical in shape and having side walls defining an interior cavity and an upper circumference defining a rim of the interior cavity; at least one LED housed in the interior cavity of the body portion below the upper circumference such that an entirety of the at least one LED is positioned below the rim of the interior cavity, wherein the at least one LED is configured such that an optical axis of the at least one LED is vertically oriented relative to the base portion; an electronics assembly housed in the interior cavity of the body portion and operably engaged with the base portion and the at least one LED and comprising an LED driver configured to provide a flow of power between the electrical connector and the at least one LED; and a lens portion coupled to the upper circumference of the body portion, the lens portion comprising a diffuser configured to scatter a directional emission of light from the at least one LED such that the light emitting apparatus comprises a non-directional photometric distribution, wherein the lens portion is opaque in appearance when the at least one LED is disengaged.

In accordance with various aspects of the present disclosure, certain embodiments of the light emitting apparatus may be configured wherein the at least one LED comprises a chip-on-board LED. In certain embodiments, the light emitting apparatus may be configured as a miniature LED bulb wherein the body portion and the lens portion of the light emitting apparatus may together (i.e., exclusive of the base portion) be less than 25 millimeters in length. In certain embodiments, the at least one LED and the electronics assembly may be operably configured to comprise a luminous efficiency of at least 50 lumens per watt. In certain embodiments, the directional emission of light from the at least one LED may comprise a beam angle in the range of about 90 degrees to about 135 degrees. In certain embodiments, the lens portion may comprise a polycarbonate material having a concentration of light-diffusing particles blended therein. In certain embodiments, the polycarbonate material may comprise a haze percentage of at least 90%.

Further aspects of the present disclosure provide for a light emitting apparatus comprising a base portion comprising an electrical connector configured to receive a flow of power from a power source; a body portion coupled to the base portion, the body portion being substantially cylindrical in shape and having side walls defining an interior cavity and an upper circumference defining a rim of the interior cavity; at least one LED housed in the interior cavity of the body portion below the upper circumference, the at least one LED comprising a chip-on-board LED configured to emit a visible light output comprising a directional beam spread having a beam angle in the range of about 90 degrees to about 135 degrees, wherein the at least one LED is configured such that an optical axis of the chip-on-board LED is vertically oriented relative to the base portion; an electronics assembly housed in the interior cavity of the body portion and operably engaged with the base portion and the at least one LED and comprising an LED driver configured to provide a flow of power between the electrical connector and the at least one LED; and a lens portion coupled to the upper circumference of the body portion and configured to diffuse the visible light output of the chip-on-board LED such that light emitting apparatus comprising a photometric distribution in the range of about 150 degrees to about 270 degrees, wherein the lens portion is opaque in appearance when the at least one LED is disengaged.

In accordance with various aspects of the present disclosure, certain embodiments of the light emitting apparatus may be configured as a miniature LED bulb wherein the body portion and the lens portion together (i.e., exclusive of the base portion) are less than 25 millimeters in length. In certain embodiments, the light emitting apparatus may be configured wherein the at least one LED and the electronics assembly are operably configured to comprise a luminous efficiency of at least 50 lumens per watt. The light emitting apparatus of the present disclosure may be further configured wherein the lens portion comprises a polycarbonate material having a concentration of light-diffusing particles blended therein. The polycarbonate material may comprise a haze percentage of at least 90%. In accordance with certain embodiments, the light-diffusing particles may be irregular or asymmetrical in shape and the concentration of light-diffusing particles may comprise a plurality of organic polymer particles. The plurality of organic polymer particles may have a mean particle size in the range of about 5 microns to about 7 microns.

Still further aspects of the present disclosure provide for a light emitting apparatus comprising a base portion comprising an electrical connector configured to receive a flow of power from a power source; a body portion coupled to the base portion, the body portion being substantially cylindrical in shape and having side walls defining an interior cavity and an upper circumference defining a rim of the interior cavity; at least one LED housed in the interior cavity of the body portion below the upper circumference, wherein the at least one LED is configured such that an optical axis of the at least one LED is vertically oriented relative to the base portion; an electronics assembly housed in the interior cavity of the body portion and operably engaged with the base portion and the at least one LED and comprising an LED driver configured to provide a flow of power between the electrical connector and the at least one LED; and a lens portion coupled to the upper circumference of the body portion, the lens portion comprising a thermoplastic matrix comprising a polycarbonate material having a concentration of light-diffusing particles blended therein to comprise a haze percentage of at least 90%, wherein the lens portion is opaque in appearance when the at least one LED is disengaged. In certain embodiments, the haze percentage of the polycarbonate material may be 100%.

In certain embodiments, the light emitting apparatus may be configured wherein the concentration of light-diffusing particles comprises a plurality of organic polymer particles having a mean particle size in the range of about 5 microns to about 7 microns. The light-diffusing particles may be irregular or asymmetrical in shape. In accordance with certain embodiments of the present disclosure, the light emitting apparatus may be configured as a miniature LED bulb wherein the body portion and the lens portion together are less than 25 millimeters in length. The light emitting apparatus may be further configured wherein the at least one LED and the electronics assembly are operably configured to comprise a luminous efficiency of at least 50 lumens per watt.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The skilled artisan will understand that the figures, described herein, are for illustration purposes only. It is to be understood that in some instances various aspects of the described implementations may be shown exaggerated or enlarged to facilitate an understanding of the described implementations. In the drawings, like reference characters generally refer to like features, functionally similar and/or structurally similar elements throughout the various drawings. The drawings are not necessarily to scale, emphasis instead being placed upon illustrating the principles of the teachings. The drawings are not intended to limit the scope of the present teachings in any way. The system and method may be better understood from the following illustrative description with reference to the following drawings in which.

DETAILED DESCRIPTION

Figure 1:
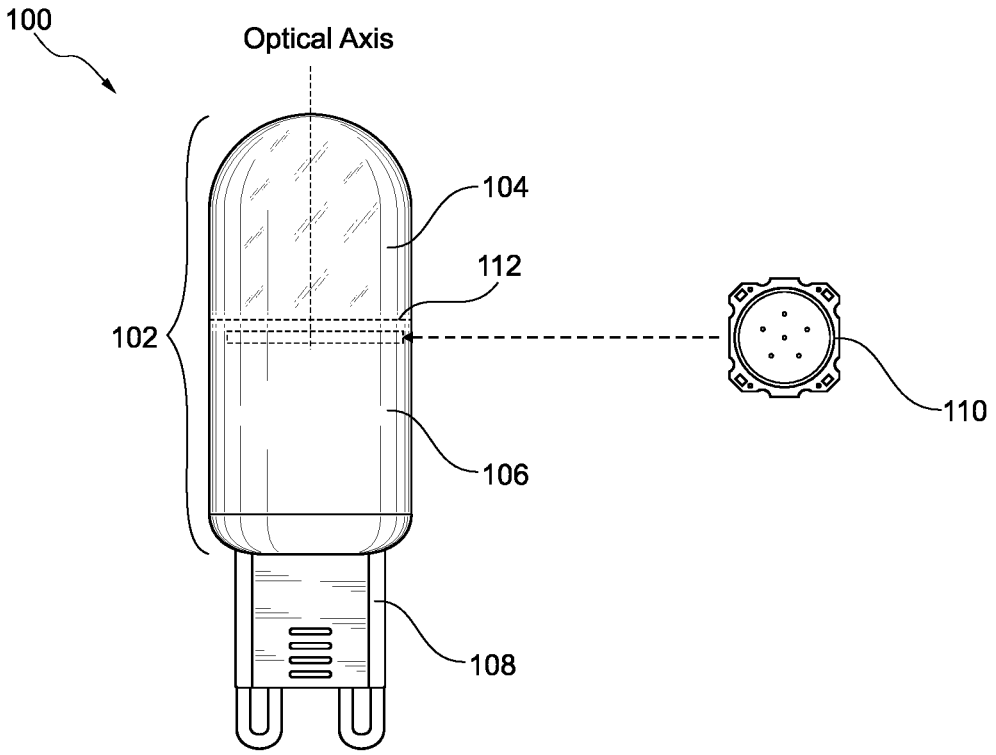
FIG. 1 is a perspective view of a light emitting apparatus with a chip-on-board LED emitter, in accordance with certain aspects of the present disclosure.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout. All definitions, as defined and used herein, should be understood to control over dictionary definitions, definitions in documents incorporated by reference, and/or ordinary meanings of the defined terms.

Following below are more detailed descriptions of various concepts related to, and embodiments of, inventive methods, devices and systems configured to provide for a base portion comprising an electrical connector configured to receive a flow of power from a power source; a body portion coupled to the base portion, the body portion being substantially cylindrical in shape and having side walls defining an interior cavity and an upper circumference defining a rim of the interior cavity; at least one LED housed in the interior cavity of the body portion below the upper circumference such that an entirety of the at least one LED is positioned below the rim of the interior cavity, wherein the at least one LED is configured such that an optical axis of the at least one LED is vertically oriented relative to the base portion; an electronics assembly housed in the interior cavity of the body portion and operably engaged with the base portion and the at least one LED and comprising an LED driver configured to provide a flow of power between the electrical connector and the at least one LED; and a lens portion coupled to the upper circumference of the body portion, the lens portion comprising a diffuser configured to scatter a directional emission of light from the at least one LED such that the light emitting apparatus comprises a non-directional photometric distribution, wherein the lens portion is opaque in appearance when the at least one LED is disengaged.

It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes. The present disclosure should in no way be limited to the exemplary implementation and techniques illustrated in the drawings and described below.

Where a range of values is provided, it is understood that each intervening value, to the tenth of the unit of the lower limit unless the context clearly dictates otherwise, between the upper and lower limit of that range and any other stated or intervening value in that stated range is encompassed by the invention. The upper and lower limits of these smaller ranges may independently be included in the smaller ranges, and are also encompassed by the invention, subject to any specifically excluded limit in a stated range. Where a stated range includes one or both of the endpoint limits, ranges excluding either or both of those included endpoints are also included in the scope of the invention.

As used herein, "exemplary" means serving as an example or illustration and does not necessarily denote ideal or best.

As used herein, the term "includes" means includes but is not limited to, the term "including" means including but not limited to. The term "based on" means based at least in part on.

As used herein, the term "interface" means any shared boundary or connection between two dissimilar objects, devices or systems through which information or power is passed and/or a mechanical, functional and/or operational relationship is established and/or accomplished. Such shared boundary or connection may be physical, electrical, logical and/or combinations thereof.

As used herein, the term "LED" refers to any type of light source comprising a light-emitting diode. A light-emitting diode is a semiconductor light source that emits light when current flows through it.

As used herein, the term "miniature" or "miniature bulbs" refers to miniature types of light bulbs identifiable by a number or numerical/alphabetical code that conforms to International Standards set forth by ANSI (American National Standards Institute) and/or the ISO (International Standards Organization) for such light bulbs. Miniature bulbs may generally comprise low voltage bulb types but may include some miniature bulbs being in the 120-to-280-volt range (e.g., 277v). Miniature bulbs may comprise a variety of sizes, bases and filament designs; for example, a T-3/4 miniature bulb may comprise a diameter as small as 0.09" (2.3 mm), while an R-12 miniature bulb may comprise a diameter as large as 1½" (38 mm). A person having ordinary skill in the art may readily substitute the term "miniature bulb" for alternative industry terms including, but not limited to, Miniature Light Bulbs, Miniature Lamp(s), Miniature Indicator Bulb(s), Miniature Indicator Light Bulbs, Miniature Indicator Light, Mini LED Lamp, Mini Lamps, Mini Bulb, Mini Light Bulb, Miniature Lamp Bulbs, LED Miniature Bulbs and the like.

As used herein, the term "acrylic polymers" are meant to include polymers, and copolymers having two or more different monomer units that are formed from alkyl methacrylate and alkyl acrylate monomers, and mixtures thereof. The alkyl methacrylate monomer is preferably methyl methacrylate, which may make up from greater than 50 to 100 percent of the monomer mixture; 0 to less than 50 percent of other acrylate and methacrylate monomers or other ethylenically unsaturated monomers, included but not limited to, styrene, alpha methyl styrene, acrylonitrile, and crosslinkers at low levels may also be present in the monomer mixture. Suitable acrylate and methacrylate comonomers include, but are not limited to, methyl acrylate, ethyl acrylate and ethyl methacrylate, butyl acrylate and butyl methacrylate, iso-octyl methacrylate and iso-octyl acrylate, lauryl acrylate and lauryl methacrylate, stearyl acrylate and stearyl methacrylate, isobornyl acrylate and isobornyl methacrylate, methoxy ethyl acrylate and methoxy methacrylate, 2-ethoxy ethyl acrylate and 2-ethoxy ethyl methacrylate, and dimethylamino ethyl acrylate and dimethylamino ethyl methacrylate monomers. (Meth) acrylic acids such as methacrylic acid and acrylic acid can be useful for the monomer mixture. Most preferably the acrylic polymer is a copolymer having 70-99.5 weight percent and more preferably 80 to 99 percent of methyl methacrylate units and from 0.5 to 30 weight percent of one or more C1-8 straight or branched alkyl acrylate units. An acrylic polymer may include an alloy with one or more compatible polymers. Preferred alloys are PMMA/polyvinylidene fluoride (PVDF) alloys, and PMMA/polylactic acid (PLA) alloys. The alloy contains 2 to 95 weight percent, preferably 5 to 90 weight percent, and more preferably 20-80 weight percent of the PMMA homopolymer or copolymer, and 5 to 98 weight percent, preferably 10 to 95 weight percent and more preferably 20 to 80 weight percent of the compatible polymer.

Certain benefits and advantages of the present disclosure include a light emitting apparatus with a hidden light emitting diode and a light diffusing lens having an opaque appearance that displays improved light dispersion and reflection properties, as compared to prior art solutions.

Further benefits and advantages of the present disclosure include a light emitting apparatus with a hidden light emitting diode and a light diffusing lens having an opaque appearance that displays improved heat dissipation, as compared to prior art solutions.

Further benefits and advantages of the present disclosure include a light emitting apparatus with a light diffusing lens having an opaque appearance that enables omnidirectional light dispersion from a directional chip-on-board LED emitter.

Further benefits and advantages of the present disclosure include a light emitting apparatus with a light diffusing lens having an opaque appearance and at least one LED emitter that is hidden from view when the light emitting apparatus is both ON and OFF.

Turning now descriptively to the drawings, in which similar reference characters denote similar elements throughout the several views, FIG. 1 depicts a light emitting apparatus 100. In accordance with certain aspects of the present disclosure, light emitting apparatus 100 comprises an envelope portion 102 and a base portion 108. Envelope portion 102 is comprised of a lens portion 104 and a body portion 106. In accordance with various embodiments, base portion 108 may comprise electrical contacts configured to interface with various types of conventional lighting fixtures and may comprise conventional miniature bulb bases, including, but not limited to: G9, E11 (Miniature Candelabra), E26 (Medium Screw), E39 (Mogul Screw), EX39 (Mogul Exclusionary), BA15d (Double Contact Bayonet), BA15s (Single Contact Bayonet), FA8, G4, and the like. In certain embodiments, envelope portion 102 may be 25 millimeters or less in length. In certain embodiments, an LED 110 may be mounted in an interior portion of body portion 106 below an upper perimeter of body portion 106 defining a rim 112. In certain embodiments, LED 110 may comprise a chip-on-board (COB) LED. In accordance with various aspects of the present disclosure, a COB LED refers to the mounting of an LED chip directly in contact with a substrate, such as silicon carbide (SiC) or sapphire, to produce an LED emitter and/or LED arrays. COB technology exhibits a much higher lumen density, for example. This is achieved through the use of several diodes (e.g., nine or more) whereas older LED iterations commonly use only one (DIP LEDs) or three (SMD LEDs). Utilizing more diodes in an LED means that there will be a higher and more uniform light intensity whilst footprint is simultaneously reduced. COB technology also makes use of a single circuit design with two contacts regardless of how many diodes are on the chip, making LEDs far simpler. Other advantages of COB LEDs include a highly compact, small size design, as compared to surface-mounted LED arrays; greater intensity, particularly at close distances; high uniformity even when at close working distances; a simpler single circuit design; and superior thermal performance for increased stability and reliability. LED 110 may be oriented in the interior portion of body portion 106 such that an optical axis of LED 110 extends through a vertical center axis of envelope portion 102. In accordance with certain embodiments, lens portion 104 may be opaque in color/appearance such that an interior portion of light emitting apparatus 100 is hidden from the view of an observer. LED 110 may be configured to emit a visible light output comprising a directional beam spread in the range of 90 degrees to 150 degrees; and more preferably 120 degrees. As described in more detail below, lens portion 104 may be comprised of a thermoplastic matrix having optical properties configured to enable omnidirectional dispersion of light emitting from LED 110.

In accordance with various aspects of the present disclosure, still referring to FIG. 1, light emitting apparatus 100 may comprise an LED lamp comprising an omnidirectional and/or non-directional photometric distribution through the use of one or more directional LED (e.g., LED 110) operably engaged with a diffuser (e.g., lens 104) configured to scatter a visible light output of the one or more directional LED. In accordance with various embodiments, the diffuser (e.g., lens 104) may be constructed of a polycarbonate material have a concentration of light-diffusing particles blended therein. The concentration of light diffusing particles may comprise organic polymer particles configured to cause a visible haze to the surface of the polycarbonate material such that the diffuser (e.g., lens 104) appears opaque to a viewer of light emitting apparatus 100 while maintaining the optical transmission of incident light through the surface of the diffuser (e.g., lens 104). In accordance with various embodiments, the polycarbonate material of lens 104 may comprise a haze percentage of greater than 90%; and more preferably, a haze percentage of 100%. In certain embodiments, haze percentage may comprise a measured percentage of incident light scattered by more than 2.5 degrees through the polycarbonate material. Alternatively, or additionally, haze may also generally refer to a percentage of opacity in terms of visual appearance (i.e., the ability to see through) of the polycarbonate material.

Certain objects of the present disclosure include an LED lamp (e.g., light emitting apparatus 100) that prevents a viewer from being able to see any/all LED emitters contained within the LED lamp without the use of a pigmentation, colored coating or refractive/reflective lens. In accordance with various aspects of the present disclosure, light emitting apparatus 100 enables the following advantages including, but not limited to, (1) an aesthetically enhanced LED lamp that hides/obscures any/all LED emitters contained within the LED lamp, such that a viewer of the LED lamp is prevented from viewing any/all of LED emitters when the LED lamp is both ON and OFF; (2) an aesthetically enhanced LED lamp that hides/obscures any/all LED emitters contained within the LED lamp from the view of a viewer without the use of a pigmentation being added to the lens material or a pigmented/colored coating being added to a surface of the lens; and (3) an aesthetically enhanced LED lamp that hides/obscures any/all LED emitters contained within the LED lamp while providing an omnidirectional and/or non-directional photometric distribution of a visible light output. In accordance with various aspects of the present disclosure, light emitting apparatus 100 is configured to enable the above-mentioned advantages by positioning an LED emitter (e.g., LED 110) within an interior cavity of an LED lamp body (e.g., body portion 106) such that an entirety of the LED emitter (e.g., LED 110) is positioned below an upper circumference (e.g., rim 112) of the LED lamp body (e.g., body portion 106) such that the LED emitter is positioned horizontally; e.g., positioned such that the LED emitter is oriented to produce a visible light output having a vertical optical axis relative to the LED lamp body (e.g., body portion 106). A lens portion (e.g., lens 104) is coupled to the upper circumference (e.g., rim 112) of the LED lamp body (e.g., body portion 106) such that a visible light output of the LED emitter is received as incident light at an interior surface of the lens portion. The lens portion (e.g., lens 104) may be constructed of a thermoplastic matrix comprising a polycarbonate material having a concentration of light-diffusing particles blended therein configured to diffuse incident light received at the interior surface of the lens portion and scatter the light according to a non-directional or omnidirectional photometric distribution. In accordance with certain embodiments, the concentration of light-diffusing particles produces a visible haze to the polycarbonate material. In a preferred embodiment, the thermoplastic matrix comprises a concentration of the light-diffusing particles sufficient to cause an opaque appearance to the surface of the lens portion (e.g., lens 104). In certain embodiments, the concentration of light-diffusing particles may comprise a concentration of organic polymer particles configured to reflect incident light received at a particle surface. The organic polymer particles may comprise a mean particle size in the range of about 5 microns to about 7 microns and may be irregular or asymmetrical in shape so as to scatter incident light according to a non-directional or omnidirectional photometric distribution.

Figure 2A:
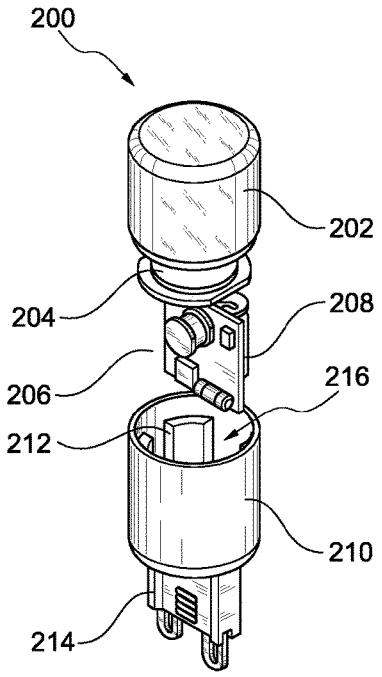
FIG. 2A is an exploded view of a light emitting apparatus, in accordance with certain aspects of the present disclosure.
Figure 2B:
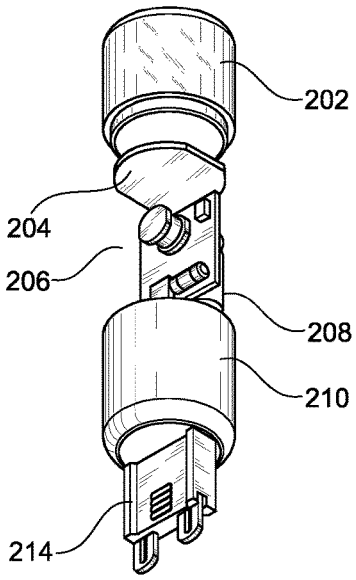
FIG. 2B is an alternate exploded view of a light emitting apparatus, in accordance with certain aspects of the present disclosure.
Figure 2C:
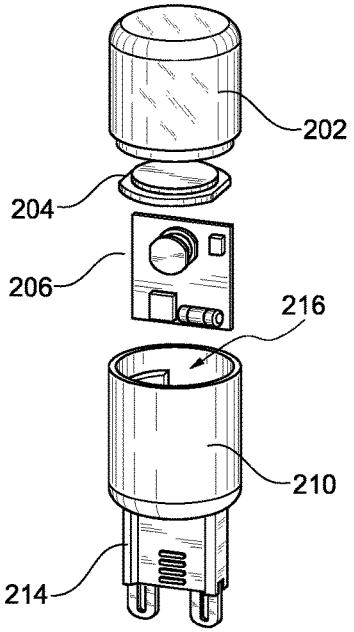
FIG. 2C is an alternate exploded view of a light emitting apparatus, in accordance with certain aspects of the present disclosure.
Figure 2D:
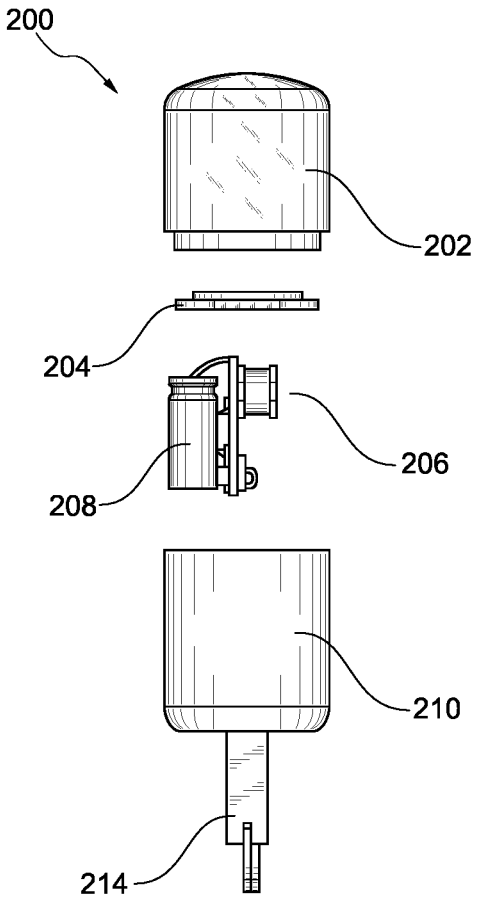
FIG. 2D is an alternate exploded view of a light emitting apparatus, in accordance with certain aspects of the present disclosure.
Figure 2E:
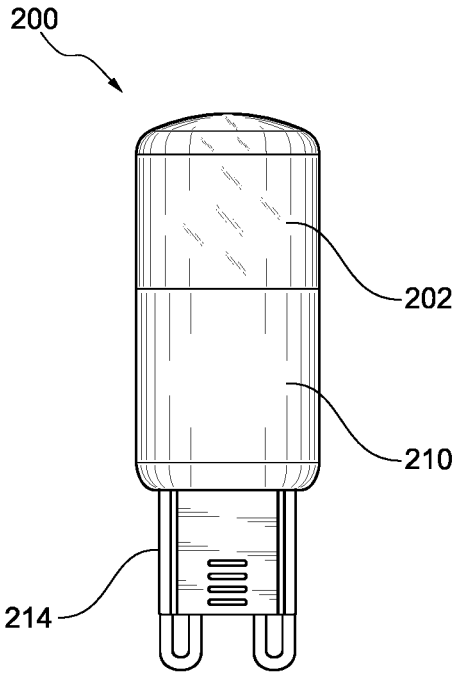
FIG. 2E is a front plan view of a light emitting apparatus, in accordance with certain aspects of the present disclosure.

Turning now to FIGS. 2A-2E, various exploded views and perspective views of a light emitting apparatus assembly 200 are shown. In accordance with certain aspects of the present disclosure, light emitting apparatus assembly 200 may comprise an assembly of light emitting apparatus 100 (as shown in FIG. 1). Light emitting apparatus assembly 200 may comprise a lens 202, a COB LED 204, an electronics assembly 206, an LED driver 208, a body portion 210 comprising a heat sink 212 and interior portion 216, and a base 214. Base 214 may comprise a standard light emitting apparatus base type, such as those described in FIG. 1. In certain embodiments, body portion 210 and heat sink 212 may be comprised of a ceramic material to enhance the dissipation of heat generated by COB LED 204 when in use. Electronics assembly 206 and COB LED 204 may be housed in interior portion 216 of body portion 210. COB LED 204 may comprise a ceramic or aluminum substrate and may be mounted in direct contact with heat sink 212 within interior portion 216. In accordance with certain embodiments, COB LED 204 may be mounted within interior portion 216 such that an LED array of COB LED 204 may be oriented below an upper circumference of body portion 210. Lens 202 may comprise a flange or other connector portion configured to mateably interface with a lower portion of lens 202 with an upper portion of body portion 210 (as shown in FIG. 2E). In accordance with various aspects of the present disclosure, lens 202 may be constructed from a polycarbonate or polycarbonate blend material melt blended with a concentration of polymeric diffusion particles to comprise a thermoplastic matrix having an opaque appearance.

In accordance with various aspects of the present disclosure, still referring to FIGS. 2A-2E, base 214 may comprise an electrical connector configured to receive a flow of power from a power source comprising a lighting fixture. Base 214 may be operably engaged with electronics assembly 206 to provide a flow of power between the electrical connector and COB LED 204. COB LED 204 may be operably engaged with electronics assembly 206 to receive a flow of power from the electrical connecter and emit a visible light output. In certain embodiments, COB LED 204 is configured to produce a visible light output having a directional beam spread; for example, a directional beam spread having a beam angle in the range of about 90 degrees to about 135 degrees. In a preferred embodiment, COB LED 204 comprises a beam angle of 120 degrees. In certain embodiments, COB LED 204 is horizontally oriented in the interior portion 216 of body portion 210 such that an optical axis of COB LED 204 is vertically oriented relative to the body portion 210. In certain embodiments, COB LED 204 and electronics assembly 206 are operably configured to produce a luminous efficiency of at least 50 lumens per watt; and more preferably, a luminous efficiency of 100 lumens per watt.

Figure 3A:
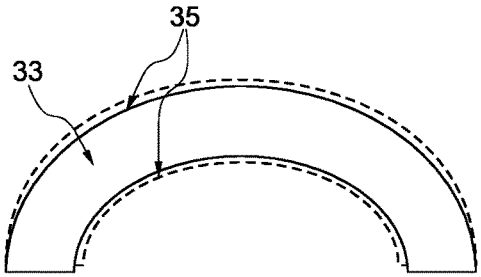
Fig. 3A Prior Art
FIG. 3A is a cross-sectional view of a prior art lens.
Figure 3B:
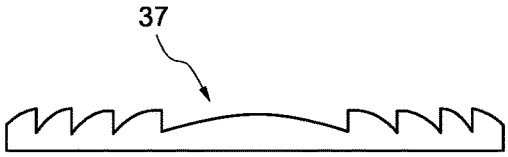
FIG. 3B is a cross-sectional view of a prior art lens.
Figure 3C:
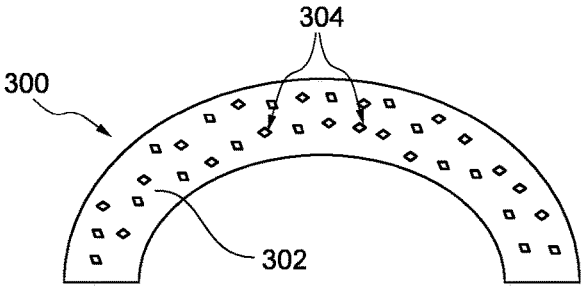
FIG. 3C is a cross-sectional view of a thermoplastic matrix of a polycarbonate lens, in accordance with certain aspects of the present disclosure.

Turning now to FIGS. 3A-3C, FIGS. 3A-3B are cross-sectional views of prior art lenses. Certain prior art solutions, such as those described above, seek to solve the problem of concealing LED diodes from view by applying pigmentation to a surface of an LED bulb. For example, FIG. 3A shows a cross-sectional view of a prior art lens 33 comprising a pigmentation 35 disposed on one or both of an interior/exterior surface of lens 33. Such solutions decrease the transmittance of both light and heat from the LED array and decrease the luminous output, performance and longevity of the LED array. Certain prior art solutions, such as those described above, seek to solve the problem of increasing the output pattern of a directional LED array by utilizing a lens having certain surface characteristics. For example, FIG. 3B shows a cross-sectional view of a prior art lens 37 that embodies a typical Fresnel-type lens that may be commonly utilized by prior art solutions to increase the output pattern (and improve other certain optical characteristics) of a directional LED array.

Figure 4:
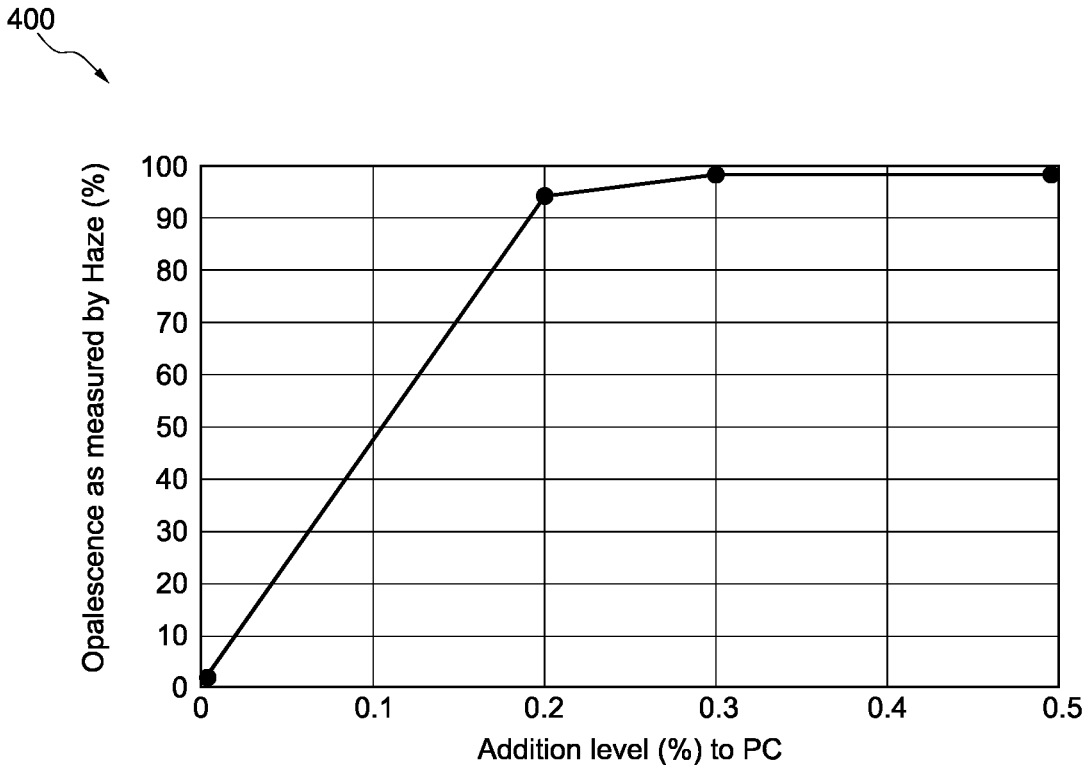
FIG. 4 is a graph of a haze percentage of a polycarbonate lens comprising varying concentrations of diffusion particles in a thermoplastic matrix, in accordance with certain aspects of the present disclosure.

Turning now to FIG. 3C (with reference to FIG. 4), a cross-sectional view of a lens 300 is shown. Lens 300 may be embodied as lens 104 (as shown in FIG. 1) and/or lens 202 (as shown in FIGS. 2A-2E). In accordance with various aspects of the present disclosure, lens 300 may comprise a composition of polycarbonate/polycarbonate blend 302 melt blended with a concentration of light diffusing particles 304 to comprise a thermoplastic matrix having the desired optical properties and thermal performance, as described in detail herein. In accordance with various embodiments, light diffusing particles 304 comprise an acrylic bead with a mean particle size in the range of about 5 microns to about 7 microns and a refractive index in the range of about 1.3 to about 1.7, and more preferably about 1.4. Light diffusing particles 304 may be melt blended with polycarbonate/polycarbonate blend 302 to provide an opaque/matte finish to the surface of lens 300 while maintaining the mechanical properties of polycarbonate/polycarbonate blend 302 at a very high level, as compared to inorganic pigments employed by prior art solutions. In accordance with certain embodiments, light diffusing particles 304 may comprise a concentration of organic (polymeric) diffusing particles of the invention that are non-spherical and have a mean particle size of from 1 to 7 microns, more preferably from 4-7 microns. Any particle size distribution can be used, though the particle size distribution is preferably relatively narrow, with 90 percent of the particles being within +/−50% of the mean particle size. Light diffusing particles 304 may consist of a single composition and size or may be a mixture of two or more different compositions and/or sizes. The particles may be homogeneous or may be of a core-shell morphology with either a soft or a hard core, and one or more shells. Light diffusing particles 304 should maintain their shape and resist deformation under normal processing conditions of heat and pressure during incorporation into the polymer matrix and subsequent formation into articles. Light diffusing particles 304 can either be high Tg polymers, such as fluoropolymers or polyamides, or may be crosslinked polymer beads. Useful polymer particles of the invention include, but are not limited to, polyamide and copolyamide particles, styrene-based particles (comprising greater than 50 percent by weight styrene monomer units), silicone particles, polytetrafluoroethylene (PTFE) particles, polyvinylidene fluoride particles, and alkyl(meth)acrylate particles. In accordance with various embodiments, light diffusing particles 304 may comprise methyl methacrylate particles. In another embodiment, acrylic copolymers containing a majority of acrylate are used. Butyl acrylate is the preferred acrylate. The acrylic copolymers can be used in a core shell bead composition. The crosslinked polymer based on methyl methacrylate or other alkyl(meth)acrylates advantageously includes from 0 to 20% of a comonomer having at least one ethylenic unsaturation copolymerizable with methyl methacrylate, chosen from styrene, alpha-methylstyrene, acrylonitrile, a C1-C10 alkyl(meth)acrylate, such as for example methyl acrylate, ethyl (meth)acrylate, butyl (meth)acrylate, benzyl (meth)acrylate, 2-hydroxyethyl (meth)acrylate and phenyl (meth)acrylate. Styrene, α-methylstyrene, benzyl methacrylate and phenyl methacrylate are monomers of choice for modifying the refractive index of the methyl-methacrylate-based particles. In one preferred embodiment, the polymer matrix and organic diffusing particles are R.I.-mismatched acrylic polymers. Light diffusing particles 304 may be melt blended with polycarbonate/polycarbonate blend 302 at varying concentrations to achieve a haze percentage of at least 90%, and more preferably 100% (as shown in FIG. 4), in order to achieve an opaque finish/appearance to the surface of lens 300.

Figure 5:
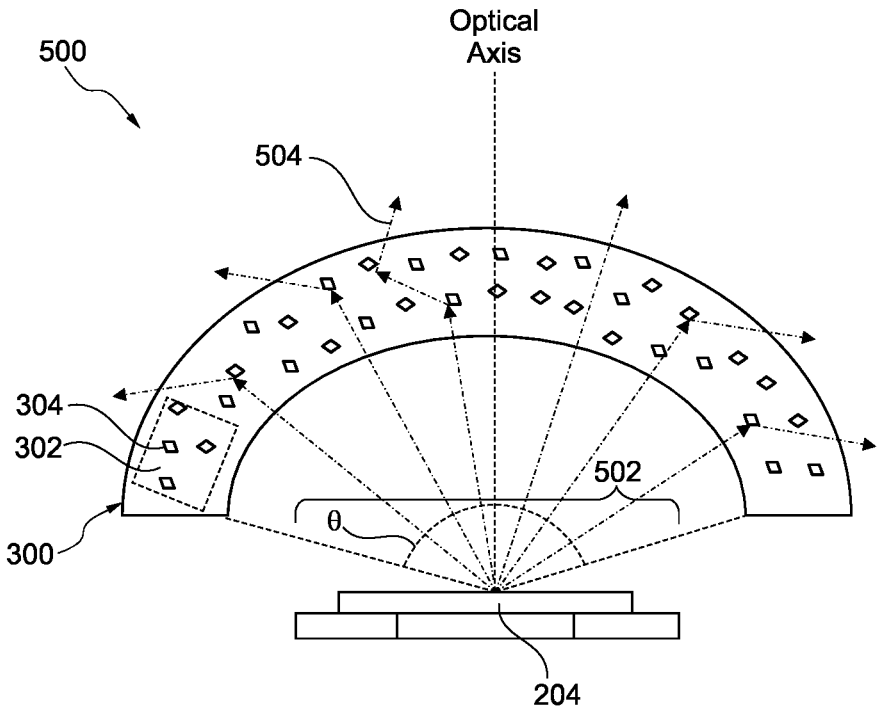
FIG. 5 is a functional diagram of a chip-on-board LED emitter and a polycarbonate lens, in accordance with certain aspects of the present disclosure.
Figure 6A:
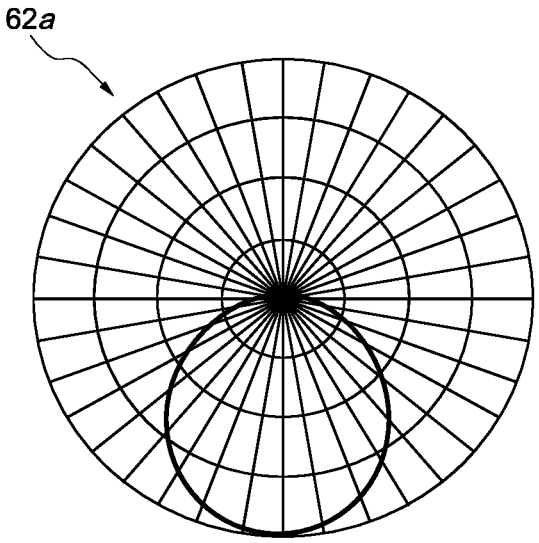
FIG. 6A is a light distribution curve of a chip-on-board LED emitter, in accordance with certain aspects of the present disclosure.

Referring now to FIG. 5 (with reference to FIGS. 6A-6B), a functional diagram 500 of a diffused light output 504 generated by COB LED 204 (as shown in FIG. 2A) operably engaged with lens 300 (as shown in FIG. 3) is shown. In accordance with certain aspects of the present disclosure, lens 300 may be embodied as lens 104 (as shown in FIG. 1) and/or lens 202 (as shown in FIGS. 2A-2E). COB LED 204 and lens 300 may comprise components of light emitting apparatus assembly 200 (as shown in FIGS. 2A-2E) and may further be embodied as an assembly of light emitting apparatus 100 (as shown in FIG. 1). In accordance with certain aspects of the present disclosure, COB LED 204 may be operably engaged (e.g., with electronics assembly 206 of FIGS. 2A-2E) to produce a visible light emission 502 having a directional photometric distribution comprising a beam angle (θ). In certain embodiments, beam angle θ may be in the range of about 90 degrees to about 135 degrees. In certain embodiments, visible light emission 502 may comprise a directional photometric distribution 62*a* comprising a beam spread of 120 degrees (as shown in FIG. 6A). Visible light emission 502 may arrive as incident light at an interior surface of lens 300 and pass through a thermoplastic matrix 302 of lens 300 before being diffused by lens 300 as a diffused light output 504. As discussed in further detail in FIG. 3, above, thermoplastic matrix 302 may comprise a concentration of light diffusing particles 304 blended therein. In accordance with certain aspects of the present disclosure, light diffusing particles 304 may comprise a plurality of organic polymer particles configured to reflect/scatter incident light received at a surface of light diffusing particles 304. In certain embodiments, the plurality of organic polymer particles may comprise a mean particle size in the range of about 5 microns to about 7 microns. In certain embodiments, light diffusing particles 304 are irregular or asymmetrical in shape such that incident light received at light diffusing particles 304 is irregularly/randomly reflected/scattered so as to produce a non-directional or omnidirectional photometric distribution of diffused light output 504.

Figure 6B:
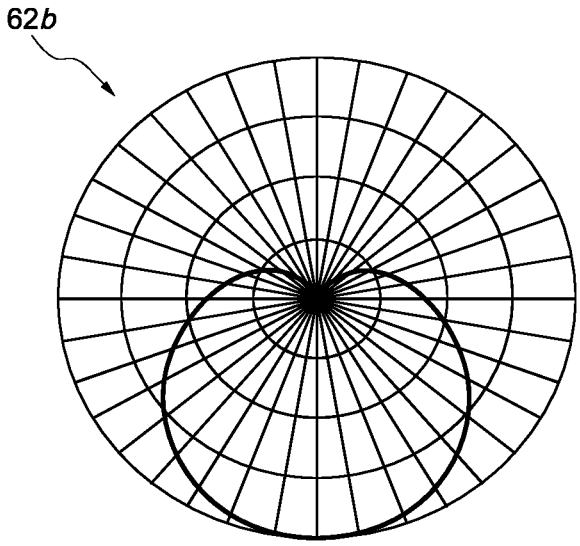
FIG. 6B is a light distribution curve of a light emitting apparatus, in accordance with certain aspects of the present disclosure.

In accordance with various aspects of the present disclosure, visible light emission 502 is emitted by COB LED 204 within a light emitting apparatus (e.g., light emitting apparatus 100 of FIG. 1). In accordance with certain embodiments, visible light emission 502 comprises a directional photometric distribution 62*a* comprising a beam spread of 120 degrees (as shown in FIG. 6A). Incident light from visible light emission 502 is received at an interior surface of lens 300 and passes through thermoplastic matrix 302 comprising a concentration of light diffusing particles 304. In certain embodiments, thermoplastic matrix 302 comprising the concentration of light diffusing particles 304 comprises a haze percentage of at least 90%; and, more preferably, a haze percentage of 100%. Visible light emission 502 is reflected and scattered by the concentration of light diffusing particles 304 as it passes through thermoplastic matrix 302. The reflected and scattered light is diffused from lens 300 as a diffused light output 504. In accordance with various aspects of the present disclosure, diffused light output 504 may comprise an omnidirectional or non-directional light output. In accordance with certain embodiments, diffused light output 504 comprises a photometric distribution 62*b* comprising a non-directional photometric distribution of 240 degrees (as shown in FIG. 6B) and may further comprise a non-directional photometric distribution in the range of about 150 degrees to about 270 degrees.

The terminology used herein is for describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including,", and variants thereof, when used herein, specify the presence of stated features, steps, operations, elements, and/or components, but do not preclude the presence or addition of one or more other features, steps, operations, elements, components, and/or groups thereof. As used herein, "exemplary" means serving as an example or illustration and does not necessarily denote ideal or best.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top, "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments. Unless otherwise defined, all terms (including technical and scientific terms) used herein have the same meaning as commonly understood by one of ordinary skill in the art to which these embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Where a range of values is provided, it is understood that each intervening value, to the tenth of the unit of the lower limit unless the context clearly dictates otherwise, between the upper and lower limit of that range and any other stated or intervening value in that stated range is encompassed by the invention. The upper and lower limits of these smaller ranges may independently be included in the smaller ranges, and are also encompassed by the invention, subject to any specifically excluded limit in a stated range. Where a stated range includes one or both of the endpoint limits, ranges excluding either or both of those included endpoints are also included in the scope of the invention.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention. Therefore, it will be apparent to those skilled in the art that various modifications and variations can be made to the disclosed embodiments without departing from the scope or spirit of the invention. In view of the foregoing, it is intended that the invention covers modifications and variations of this disclosure within the scope of the following claims and their equivalents.

What is claimed is:

1. A light emitting apparatus comprising:

a base portion comprising an electrical connector configured to receive a flow of power from a power source;

a body portion coupled to the base portion, the body portion having side walls defining an interior cavity and an upper circumference defining a rim of the interior cavity;

at least one LED housed in the interior cavity of the body portion below the upper circumference such that an entirety of the at least one LED is positioned below the rim of the interior cavity;

an electronics assembly operably engaged with the base portion and the at least one LED and comprising an LED driver configured to provide a flow of power between the electrical connector and the at least one LED; and a lens portion coupled to the upper circumference of the body portion, the lens portion comprising a diffuser configured to scatter a directional emission of light from the at least one LED such that the light emitting apparatus comprises a non-directional photometric distribution, wherein the lens portion is opaque in appearance when the at least one LED is disengaged, wherein the directional emission of light from the at least one LED comprises a beam angle in the range of about 90 degrees to about 135 degrees.

2. The light emitting apparatus of claim 1 wherein the at least one LED comprises a chip-on-board LED.

3. The light emitting apparatus of claim 1 wherein the body portion and the lens portion together are less than 25 millimeters in length.

4. The light emitting apparatus of claim 3 wherein the at least one LED and the electronics assembly are operably configured to comprise a luminous efficiency of at least 50 lumens per watt.

5. The light emitting apparatus of claim 1 wherein the lens portion comprises a polycarbonate material having a concentration of light-diffusing particles blended therein.

6. The light emitting apparatus of claim 5 wherein the lens portion comprises a haze percentage of at least 90%.

7. A light emitting apparatus comprising:

a base portion comprising an electrical connector configured to receive a flow of power from a power source;

a body portion coupled to the base portion, the body portion having side walls defining an interior cavity and an upper circumference defining a rim of the interior cavity;

at least one LED housed in the interior cavity of the body portion below the upper circumference, the at least one LED comprising a chip-on-board LED configured to emit a visible light output comprising a directional beam spread having a beam angle in the range of about 90 degrees to about 135 degrees;

an electronics assembly housed in the interior cavity of the body portion and operably engaged with the base portion and the at least one LED and comprising an LED driver configured to provide a flow of power between the electrical connector and the at least one LED; and a lens portion coupled to the upper circumference of the body portion and configured to diffuse the visible light output of the chip-on-board LED such that the light emitting apparatus comprising a photometric distribution in the range of about 150 degrees to about 270 degrees.

8. The light emitting apparatus of claim 7 wherein the body portion and the lens portion together are less than 25 millimeters in length.

9. The light emitting apparatus of claim 8 wherein the at least one LED and the electronics assembly are operably configured to comprise a luminous efficiency of at least 50 lumens per watt.

10. The light emitting apparatus of claim 7 wherein the lens portion comprises a polycarbonate material having a concentration of light-diffusing particles blended therein.

11. The light emitting apparatus of claim 10 wherein the lens portion comprises a haze percentage of at least 90%.

12. The light emitting apparatus of claim 10 wherein the light-diffusing particles are irregular or asymmetrical in shape.

13. The light emitting apparatus of claim 10 wherein the concentration of light-diffusing particles comprises a plurality of organic polymer particles having a mean particle size in the range of about 5 microns to about 7 microns.

14. A light emitting apparatus comprising:

a base portion comprising an electrical connector configured to receive a flow of power from a power source;

a body portion coupled to the base portion, the body portion having side walls defining an interior cavity and an upper circumference defining a rim of the interior cavity;

at least one LED housed in the interior cavity of the body portion below the upper circumference, wherein the at least one LED is configured such that an optical axis of the at least one LED is vertically oriented relative to the base portion;

an electronics assembly housed in the interior cavity of the body portion and operably engaged with the base portion and the at least one LED and comprising an LED driver configured to provide a flow of power between the electrical connector and the at least one LED; and a lens portion coupled to the upper circumference of the body portion, the lens portion comprising a thermoplastic matrix comprising a polycarbonate material having a concentration of light-diffusing particles blended therein comprising a haze percentage of at least 90%.

15. The light emitting apparatus of claim 14 wherein the concentration of light-diffusing particles comprises a plurality of organic polymer particles having a mean particle size in the range of about 5 microns to about 7 microns.

16. The light emitting apparatus of claim 14 wherein the light-diffusing particles are irregular or asymmetrical in shape.

17. The light emitting apparatus of claim 14 wherein the body portion and the lens portion together are less than 25 millimeters in length.

18. The light emitting apparatus of claim 17 wherein the at least one LED and the electronics assembly are operably configured to comprise a luminous efficiency of at least 50 lumens per watt.

19. The light emitting apparatus of claim 14 wherein the haze percentage is 100%.

* * * * *